United States Patent [19]

Hayward

[11] Patent Number: 4,662,154

[45] Date of Patent: May 5, 1987

[54] LIQUID INERT GAS DISPENSER AND CONTROL

[75] Inventor: Gary G. Hayward, Falmouth, Mass.

[73] Assignee: Continental Can Company, Inc., Stamford, Conn.

[21] Appl. No.: 660,614

[22] Filed: Oct. 12, 1984

[51] Int. Cl.[4] ..... B65B 55/18

[52] U.S. Cl. ..... 53/431; 53/53; 53/111 R; 53/510; 141/51; 141/83; 141/95; 141/100; 222/146.6; 222/478

[58] Field of Search ..... 53/52, 53, 54, 55, 84, 53/111 R, 431, 502, 510; 141/9, 51, 83, 95, 99, 63, 64, 95, 100, 186, 286; 222/146.6, 478, 504, 481, 510; 73/52, 178 R

[56] References Cited

U.S. PATENT DOCUMENTS

| | | | |
|---|---|---|---|
| 3,802,252 | 4/1974 | Hayward et al. | 209/590 X |
| 3,881,095 | 4/1975 | Taylor et al. | 73/178 R |
| 4,316,490 | 2/1982 | Meyer | 141/9 |
| 4,489,767 | 12/1984 | Yamada | 141/286 X |
| 4,494,582 | 1/1985 | Meyer | 141/9 |

FOREIGN PATENT DOCUMENTS

| | | | |
|---|---|---|---|
| 2162448 | 6/1973 | Fed. Rep. of Germany | 53/502 |
| 125095 | 11/1978 | Japan | 141/83 |
| 690324 | 4/1953 | United Kingdom | 141/83 |
| 2089191 | 6/1982 | United Kingdom | 53/431 |

*Primary Examiner*—Robert L. Spruill
*Assistant Examiner*—Steven P. Weihrouch
*Attorney, Agent, or Firm*—Charles E. Brown

[57] ABSTRACT

A control system for providing a closed loop control circuit between a liquid nitrogen dispenser and apparatus for determining internal pressure within a closed can having liquid nitrogen applied thereto whereby the automatic controlling of the volume of liquid nitrogen dispensed into each can is effected. Control data from a pressure test unit is averaged and the average is compared to a preselected set point and converted into a pulse of a width varying in accordance with the average detected pressure of previously filled cans to control the time of dispensing and thus the volume of dispensed liquid nitrogen.

17 Claims, 8 Drawing Figures

LIQUID INERT GAS DISPENSER AND CONTROL

This invention relates in general to the internal pressurization of containers, and more particularly to a control system for controlling the volume of a liquid inert gas which is dispensed into a container to assure proper internal pressurization of the container after it is closed.

There has been developed by Benthos, Inc. of Edgerton Drive, North Falmouth, Mass. 02556 a system for inspecting containers to determine the degree of internal pressurization of such containers. This system may be based either on the profile of the end unit in the case of a can or may be based upon the sound emitted from the container when the end thereof is depressed and released. This latter line of pressure detecting systems is known as TapTone ® system, a registered trademark of Benthos, Inc.

In the utilization of this invention, TapTone ® 4044-1 high speed line has been utilized.

As will be more specifically set forth hereinafter, the 4044-1 line not only determines whether the pressure within a container is within preset limits, but permits the controlled ejection of containers determined to have a too low internal pressure or a too high internal pressure. Basically, the system converts the sounds emitted by the containers into pressure ranges, with there being a separate and distinct signal for each pressure range and there being switch means for selectively energizing different pressure range signals to operate the container ejector.

The different pressure indicating signals may also be directed into a recorder which will provide for a running record as to the indicated pressure within each tested can.

There has also been provided apparatus for dispensing controlled quantities of a liquid inert gas such as nitrogen into a filled container before the container is closed in order to assure internal pressurization of the container due to the vaporization of the liquid inert gas. Pressure detectors and pressure indicators such as that of a 4044-1 high speed line have been used downstream of such liquid inert gas dispensers to determine whether the correct amount of liquid nitrogen, for example, has been placed in a container.

This invention particularly relates to a control system which will receive data from the 4044-1 line and convert those control signals into a control for the valve of the liquid nitrogen dispenser so as automatically to vary the time of valve opening and thus the amount of liquid nitrogen dispensed in accordance with an average pressure determined with respect to the inspected containers.

The control system in accordance with this invention will receive from the 4044-1 line exponential data and will average that data after each container is inspected and will provide digital average information which will then be converted into an analog output which will be compared with a preselected set point to provide a control pulse of a width corresponding to that required by the analog output, the length of the pulse controlling the time of valve opening and thus the volume of liquid nitrogen dispensed.

From the foregoing it is thus possible by way of this closed loop control of the addition of the liquid nitrogen automatically to vary the amount of liquid nitrogen dispensed in order to provide a constant pressure within the closed containers without requiring an observer.

In order to make certain that there is no dispensing of the liquid nitrogen when there is no container present and also to make certain that all dispensed liquid nitrogen is directed into the open mouth of a container, there is provided in association with the liquid nitrogen dispenser a container detector which will provide a control pulse corresponding in time to the time of presentation of the container in a position to receive the dispensed liquid nitrogen, with the two pulses being in series so that the container detector functions as a no container/no dispensing control and also as a dispensing termination control to prevent dispensing of liquid nitrogen after the container has proceeded too far.

This invention also relates to a novel dispenser for liquids, such as liquid nitrogen, with the dispenser having novel valve means and further utilizing the escaping gas vapor to shield operative components of the dispenser against moisture containing air, thereby preventing icing of the dispenser.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
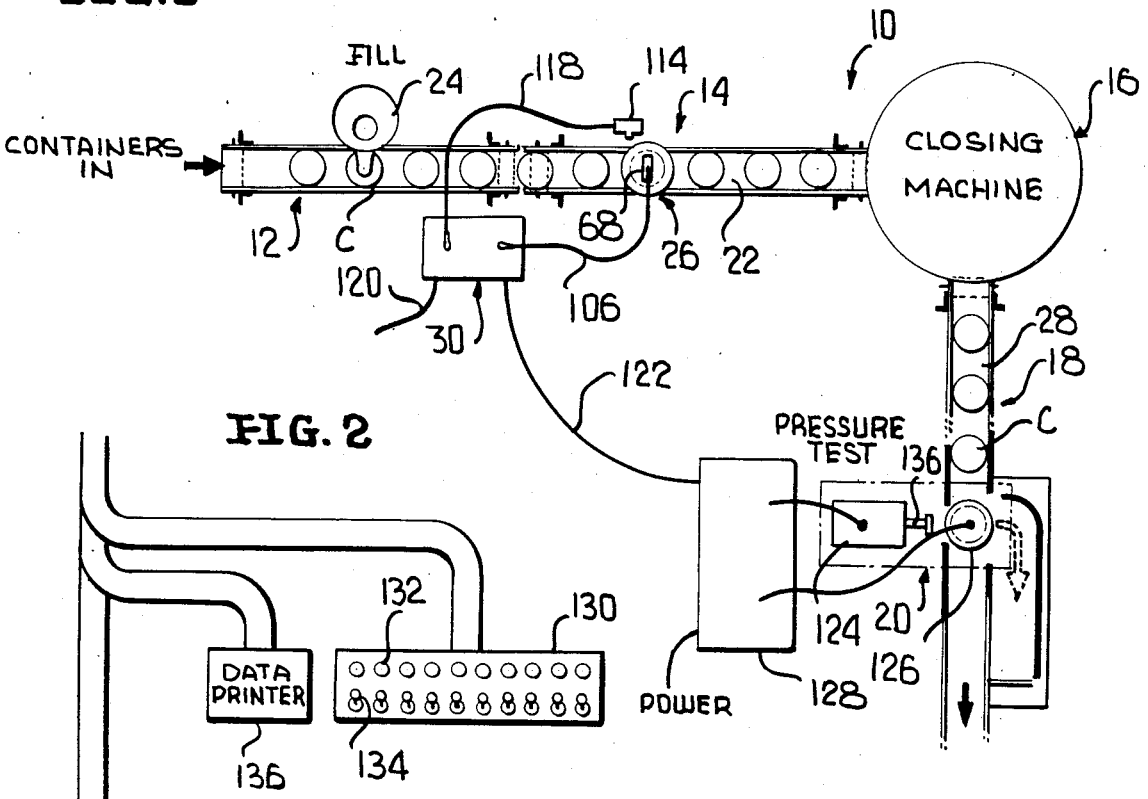
FIG. 1 is a schematic plan view of a container filling and closing line incorporating the liquid nitrogen dispenser and the pressure test and pressure determination apparatus, with the two apparatuses being coupled by a control system in accordance with this invention.

Referring now to the drawings in detail, reference is made to FIG. 1 wherein there is illustrated an apparatus 10 for the filling of a container with a product, placing liquid nitrogen on top of the product, closing the container, and testing the closed container for internal pressurization. Basically, the apparatus 10 includes a filling unit 12, a liquid nitrogen dispensing unit 14, a conventional closing machine 16, a takeaway conveyor 18, and an internal pressure testing apparatus 20. For the purposes of description, the container will be described as a can C having an open upper end which will be closed in the closing machine 16 by the application of an end unit which is secured in place by a double seaming operation.

The filling unit 12 and the liquid nitrogen dispensing apparatus 14 are disposed in alignment in end-to-end relation and have a single conveyor belt 22 which carries cans from an entrance end thereof into the closing machine with the cans C being uniformly spaced.

In the filling section the cans C are filled with the desired product using a conventional filler 24. In many instances the product placed in the cans will be a hot fill product.

After the cans have been filled, as they pass along the conveyor belt 22 they will pass under a liquid nitrogen dispenser 26. The dispensing of the liquid nitrogen will be controlled in timed relation with the positioning of a can beneath the dispenser 26 with the amount of liquid nitrogen dispensed being closely controlled in a manner to be described hereinafter.

Very shortly after the liquid nitrogen has been placed in the cans C, the cans enter the closing machine 16 and are closed in sealed condition. Thereafter, the closed cans pass out of the closing machine 16 onto a conveyor belt 28 of the takeaway unit 18. At a suitable distance from the closing machine and at a time when the liquid nitrogen has entirely vaporized and the normal pressure conditions which will continue to exist within the closed cans has been effected, the internal pressurization of the closed cans will be tested and ascertained by a pressure detector and pressure indicator of the apparatus 20. This apparatus, as described above, is preferably a 4044-1 high speed TapTone®. A feedback from the unit 20 to a control device 30 for the liquid nitrogen dispenser 26 is provided in accordance with this invention.

Figure 8:
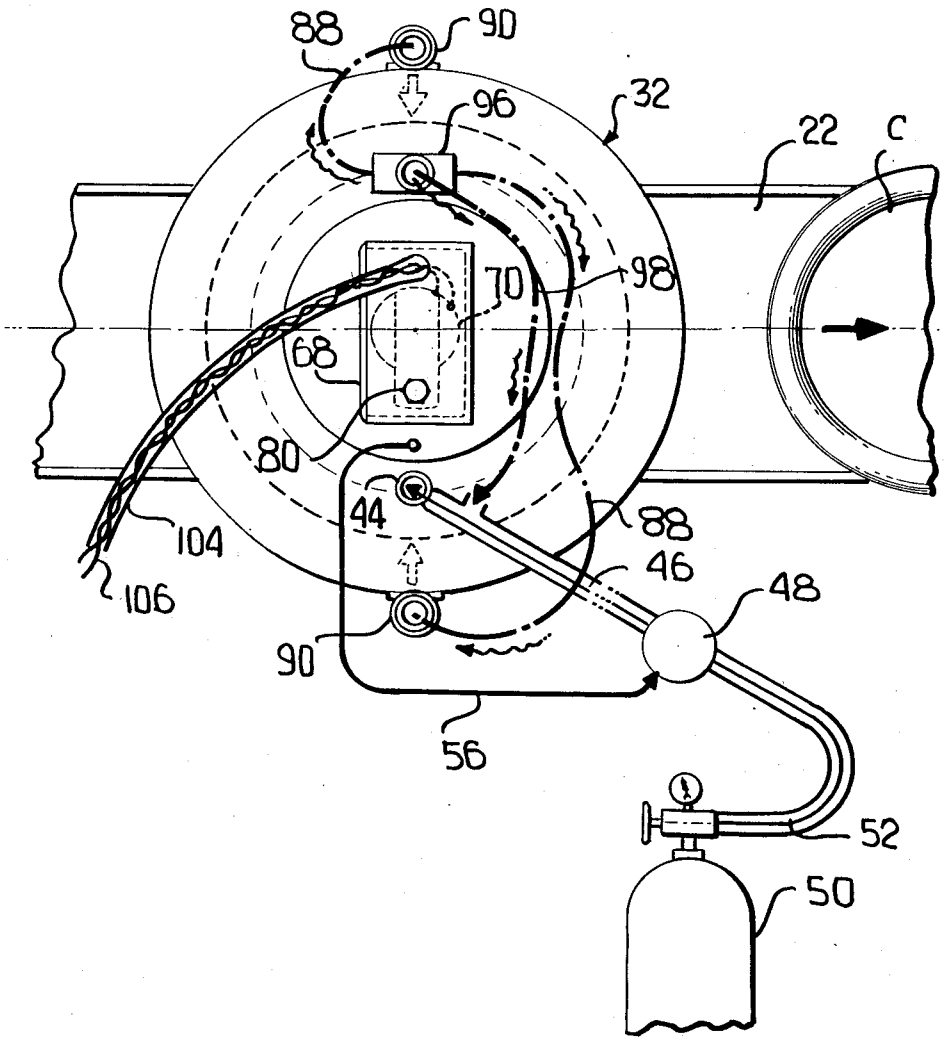
FIG. 8 is a fragmentary plan view of the dispenser, and shows further details thereof.
Figure 7:
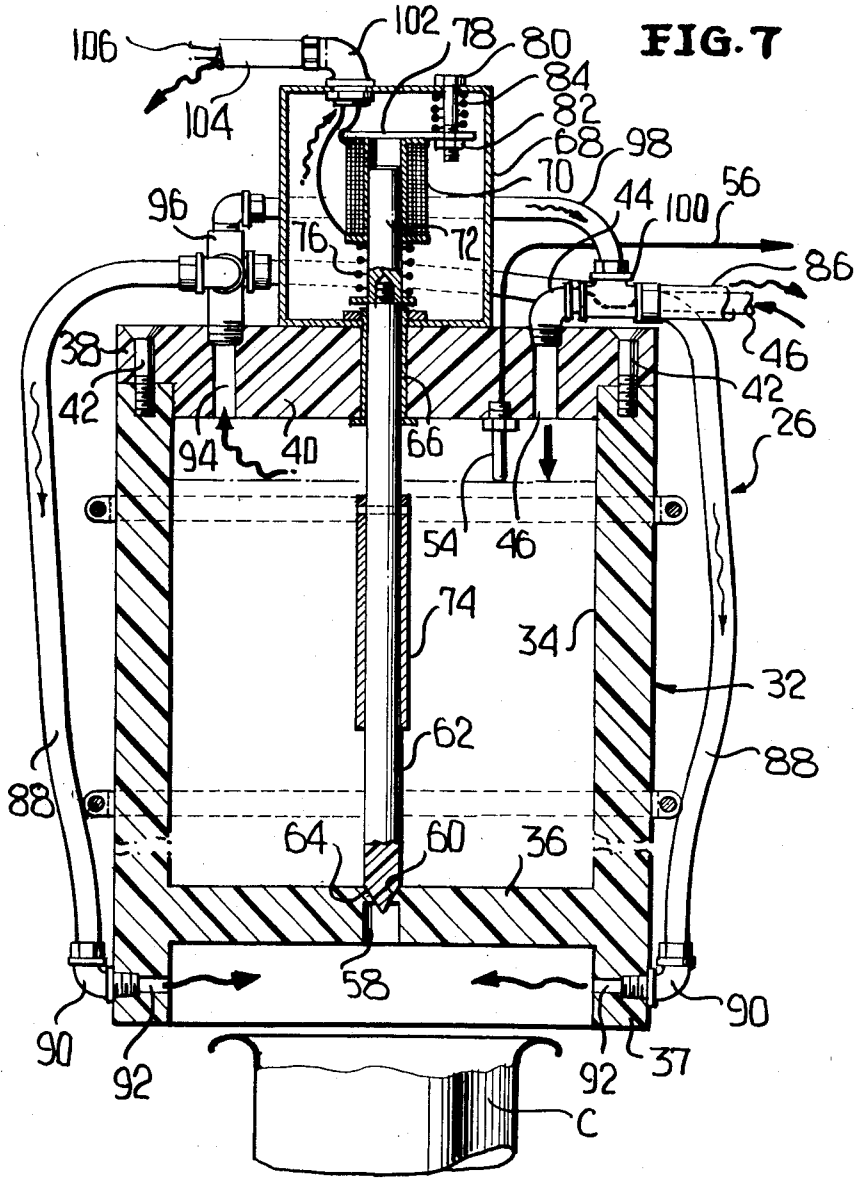
FIG. 7 is an enlarged fragmentary sectional view taken through the liquid nitrogen dispenser generally along the line 7—7 of FIG. 5, and shows the specifics of the dispenser.

Before describing in detail the control system for the liquid nitrogen dispenser 26, it is desirable to understand the details of the liquid nitrogen dispenser. Accordingly, reference is made next to FIGS. 7 and 8.

The liquid nitrogen dispenser 26 includes a liquid nitrogen tank 32 which is preferably formed of a foamed plastic material having a sufficient surface density to prevent liquid nitrogen from flowing therethrough. The tank 32 has a cylindrical body 34 with a bottom wall 36. Preferably the body 34 has a lower skirt 37 which extends down below the bottom wall 36. The tank 34 further includes a top cover 38 having a central depending plug 40 which snugly fits into the body 34 and seals the upper end. The cover 38 is attached to the body 34 by relatively light screws 42 which may rupture if there becomes an undue pressure accumulation within the tank 32 so as to avoid tank explosion.

It is to be understood that the tank 32 will be filled with liquid nitrogen or an equivalent liquid inert gas to a prescribed level not fully filling the tank 32 so that there may be space above the level of the liquid gas for vaporization. The tank 32 is provided with a filler 44 carried by the cover 38 and opening into the tank by way of a filling passage 46. The liquid gas will be supplied to the filler 44 through a supply line 46 (FIG. 8) with flow being controlled by a valve 48. The liquid gas will be supplied to the valve 48 from a supply 50 through a supply line 52.

A liquid level detector 54 will project into the tank 32 from the cover 38 and will have a control line 56 coupled to the valve 48 for effecting the automatic closing of the valve 48 when the liquid nitrogen in the tank 32 reaches a predetermined level.

Dispensing the liquid nitrogen is controlled by a very simple valve. The valve basically is in the form of a large diameter bore 58 formed on the underside of the bottom 36 and extending only partially through the bottom 36. The bore 58 will be placed into communication with the interior of the tank 32 by means of a flow passage defined by a generally conical valve seat 60. There is provided a valve member 62 in the form of an elongated plastic material rod having at its lower end a generally conical valve element 64 which matches the valve seat 60 and cooperates therewith normally to close the passage from the interior of the tank 32 into the bore 58.

The upper end of the valve member 62 extends through a sleeve 66 carried by the cover 38 and opens into the lower end of a housing 68 carrying a solenoid 70. The upper end of the valve member 62 is provided with a metal extension 72 which functions as the core for the solenoid 70. When the valve member 62 is in the form of a plastic rod, it may be provided with a metal sleeve 74 which functions solely as a weight to urge the rod which forms the valve member 62 downwardly into its seated position. Furthermore, there may be provided a spring 76 for constantly urging the valve member 62 downwardly.

It is to be understood that when the solenoid 70 is energized the core 72 will be drawn upwardly to its centered position within the solenoid 70, thus unseating the valve element 64 from the valve seat 60 and permitting liquid nitrogen to escape from the bottom of the tank. The amount of liquid nitrogen which escapes upon each opening of the valve depends upon the time that the valve is opened.

It is to be understood that there may be an adjustment of the displacement of the valve element 64 relative to the valve seat 60 by vertically adjusting the solenoid 70. To facilitate this, a mounting plate 78 of the solenoid 70 is suspended from a top wall of the housing 68 by means of a threaded support 80 which passes through a nut or like element 82 fixedly carried by the support plate 78. A spring 84 encircles the fastener 80 so as fixedly to position the solenoid 70 at all times.

It is to be understood that because of the cooling nature of the liquid nitrogen, there is a tendency for moist air to become ice, and icing up of the dispenser 26 is undesirable. It is also to be understood that since the liquid nitrogen is not under pressure within the tank 32, it will give off vapor. This slight vapor loss is put to good use.

First, the supply line 46 is encased in a suitable sheath 86. Secondly, vapor lines 88 are connected to fittings 90 carried by the skirt 37 for introducing vapor beneath the bottom 36 through passages 92.

The cover 38 is provided with a gas vent passage 94 which is provided at its outer end with a fitting 96 to which are coupled the lines 88 and a line 98 which supplies vapor to a fitting 100 and into the casing 86.

It is to be understood that there will also be gas escaping from the tank 32 through the bushing 66 to the solenoid housing 68. The solenoid housing 68 is vented through an electrical conduit coupling fitting 102 which carries a sheath 104 for control wires 106 of the solenoid 70.

Figure 4:
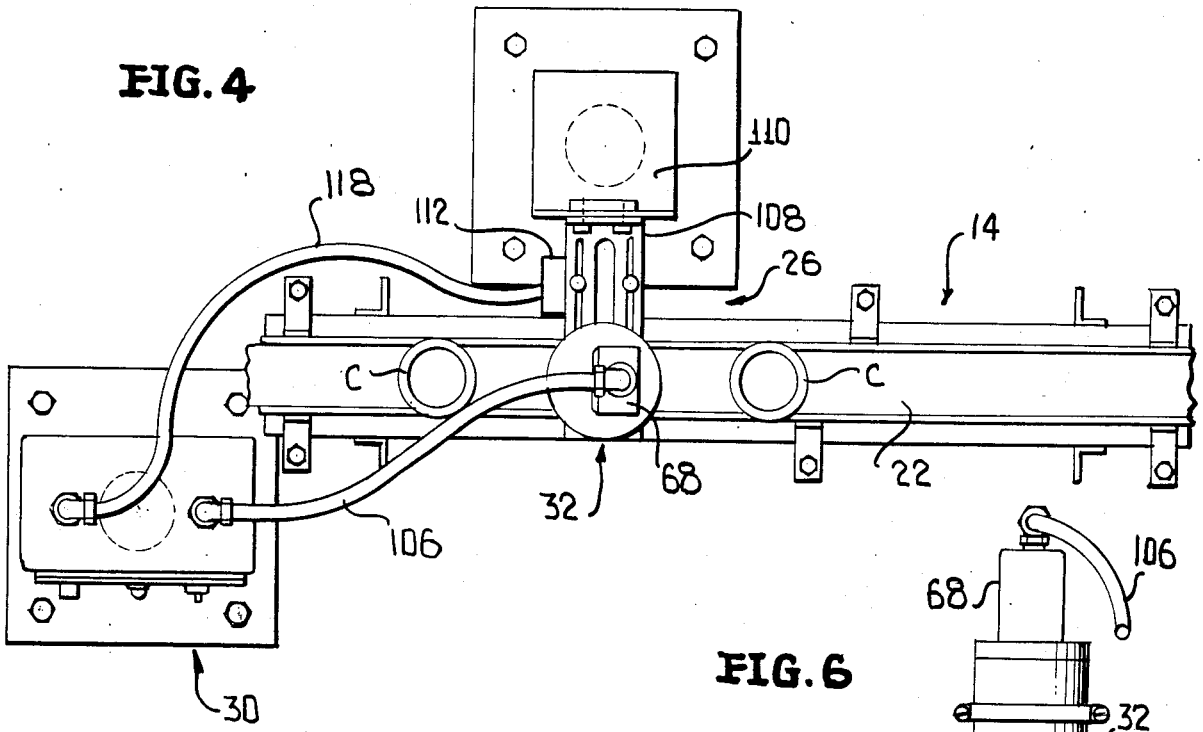
FIG. 4 is an enlarged fragmentary plan view showing more of the details of the liquid nitrogen dispenser and the controls therefor.
Figure 6:
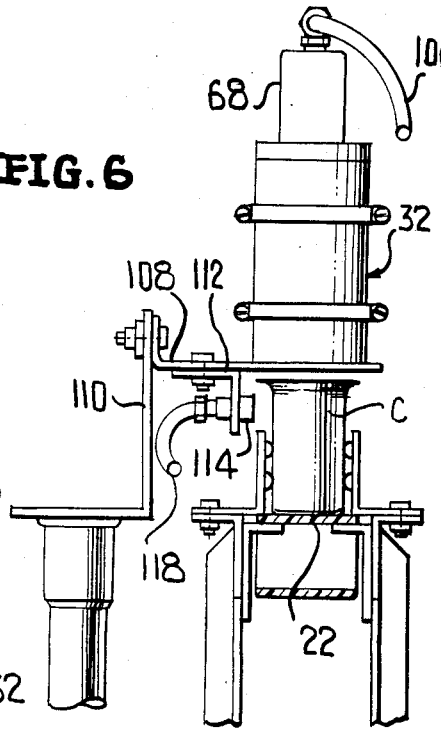
FIG. 6 is a fragmentary vertical sectional view taken generally along the line 6—6 of FIG. 5, and shows further details of the apparatus.
Figure 5:
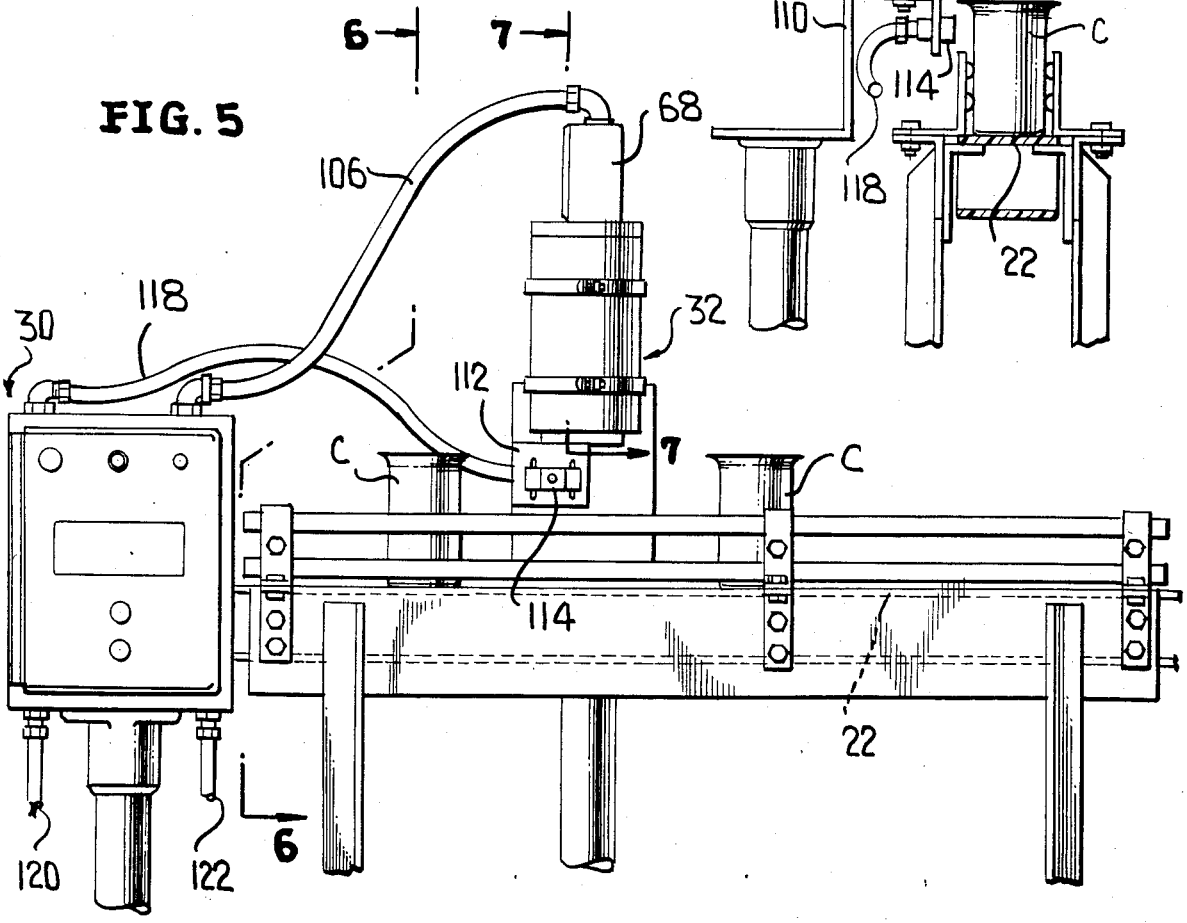
FIG. 5 is a fragmentary elevational view of the apparatus of FIG. 4.

Referring now to FIGS. 4, 5 and 6, it will be seen that the tank 32 is mounted above the conveyor belt 22 by means of a suitable support 108 which is carried by a bracket 110. It will also be seen that the support 108 carries a bracket 112 which, in turn, carries a proximity sensor 114 for determining when a can C has reached a control position beneath the tank 32.

It will be seen that the control device 30 is mounted in a suitable housing 116 which is located adjacent the tank 32 and the proximity detector 114. The housing 116 has leading thereinto control wires 106 for the solenoid 70. It also has leading thereinto control wires 118 for the proximity detector 114. It is further provided with a power line 120 and control lines 122 from the TapTone® unit 20.

The TapTone® unit 20, i.e. the pressure detector and pressure indicator unit 20, includes a fixture 124 from which a test head 126 is positioned in overlying relation to the conveyor belt 28. The test head 126 in its preferred embodiment, by way of an induced magnetic force exerts a downwardly directed force on the can end so as to deflect the can end downwardly, and when the force is released the can end pops back up with an audible click. The tone of the click indicates the internal pressure within the can. The TapTone® unit 20 by means of a control mechanism mounted within a housing 128 will produce a signal depending upon the detected pressure. For simplicity of description, it may be assumed that ten different signals will be emitted depending upon the detected pressure, with each signal differing from the next by 5 p.s.i. test results.

The manner in which the TapTone® unit 20 functions may be better understood by reference to U.S. Pat. No. 3,802,252, granted on Apr. 9, 1974 to Hayward et al.

Figure 2:
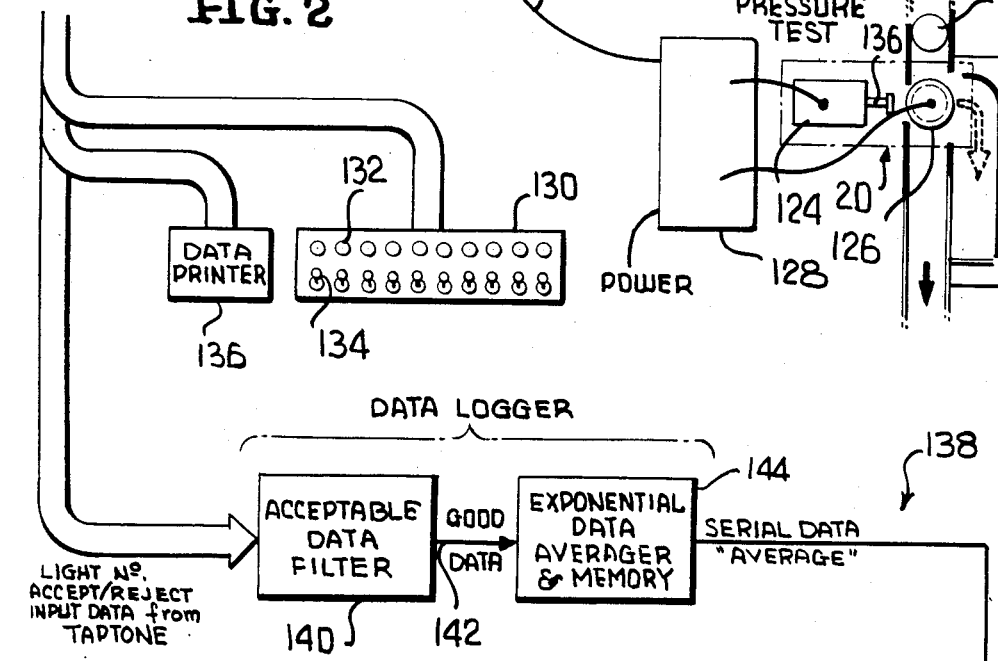
FIG. 2 is a schematic view of the control system, and shows the relationship of the control system to the pressure detecting and pressure determining apparatus and the liquid nitrogen dispenser.

Reference is made to the schematic of FIG. 2 wherein there is illustrated a display panel 130 of the unit 128 which includes a plurality of lights 132, one light for each of the ten detectable pressure ranges. Associated with each of the lights 132 is a control switch 134 which may be selectively closed to couple the pressure indicating signal to an ejector 136 (FIG. 1) which will eject cans C having a detected pressure which is below a preselected norm or above a preselected norm. For example, should the internal pressure in an inspected can be below 10 p.s.i. or above 45 p.s.i., the can will be ejected from the line as defective. This will be accomplished by closing the switches 134 for test circuits 1, 2 and 10.

It is also to be assumed for descriptive purposes only that the desired pressure within the can C will be 30 p.s.i. so that when the pressure of a typical can is ascertained it will fall within test range 6.

As the internal pressure of each can is detected, not only will the lights 132 on the panel 130 indicate the detected internal pressure of the can, but also the test result signal may be directed to a data processor 136 which will provide a permanent record of the pressure test results.

In accordance with this invention it is proposed to use the pressure test data results to control the length of time that the valve of the nitrogen dispenser is open, thereby controlling the volume of the liquid nitrogen dispensed from the tank 32.

As is shown in FIG. 2, a control system 138, which is the subject of this invention, is coupled to receive the pressure test data results from the unit 20. These signals pass into an acceptable data filter 140 which filters out incorrect data and passes good data 142 in exponential form to an exponential data averager and memory 144 which will produce a continuous signal indicative of the average of the data received from the unit 20. For example, one test result may be a 6, the next a 5, then a 6, then a 7, etc., with the average of such test results being a 6.

This averaged data is then directed to a memory and D/A converter 146 which will convert the digital average data to an analog output.

The analog output will be continuously directed into a set point comparator 148 having an adjustible set point 150 which in the described example would be set at 6. The output of the set point comparator 148 is then directed to an analog to pulse width converter 152 which will produce a pulse which is of a variable length inversely to the differential in compared data. For example, if the internal pressure within a can C is desired to average at 6 and the average data is a 7, the pulse width will be decreased while, if the average data is a 5, the pulse width will increase. As will be shown hereinafter, the width of the pulse which is the output of the converter 152 will control the length of time that the valve of the dispenser 26 is open.

The previously described proximity sensor 114 which in FIG. 2 is indicated as being a container detector, also produces a control signal and the control signals from the converter 152 and the container detector 114 will be arranged in series and will supply a signal 154 to the solenoid 70 to effect energization thereof for the selected period of time.

Figure 3:
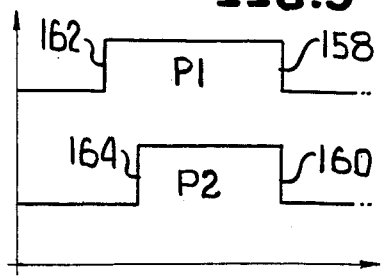
FIG. 3 is a schematic view showing the relationship of the pulses from the control system and the container position detector.

Referring now to FIG. 3, it will be seen that the container detector or proximity detector 114 will produce a pulse P1 which is of a constant predetermined length. The pulse P1 will determine the time during which a can C is positioned in underlying relation to the tank 32 for receiving liquid nitrogen from the tank. Thus the pulse P1 controls the time at which the valve of the tank 32 may open, providing that there is a can beneath the valve.

The pulse P1 has a trailing edge 158 which determines the time at which the dispensing of liquid nitrogen into an underlying can C must discontinue to assure that the dispensed liquid nitrogen will properly enter the can. The pulse P2 is so timed that its trailing edge 160 is coincident with the trailing edge 158 so that the dispensing of liquid nitrogen is always discontinued at the time determined by the pulse P1.

The pulse P1 is always greater in length than the pulse P2 and has a starting edge 162 located at a time when dispensing of the liquid nitrogen may begin. The width of the pulse P2, as stated above, is controlled in accordance with the test results from the unit 20 so as to provide for the dispensing of liquid nitrogen of a volume to provide the required internal pressure within a can. Thus the starting edge 164 of the pulse P2 will vary, but will always fall within the width of the pulse P1.

Inasmuch as the pulses P1, P2 are in series, the solenoid 70 will be energized only when the pulses P1, P2 are both effective. Thus should there be no can detected by the proximity detector 114, the pulse P1 would be nonexistent, and even though the pulse P2 calls for the energizing of the solenoid 70, there should be no energization and thus the pulse P1 will function as a no can/no dispensing control.

It is to be understood that if the average detected pressure within the tested cans falls below that provided for at the set point 150, the width of the pulse P2 will increase to provide for a longer liquid nitrogen dispensing time, and therefore the dispensing of a greater volume of liquid nitrogen. The converse will occur should the detected average pressure increase above the set norm.

It is to be understood that there are several practical applications of the liquid nitrogen or other inert gas to containers such as cans. If the product being packaged is a hot fill product, the air in the head space above the product is heated at the time the can is closed, and when the heated air cools to room temperature, a vacuum results. Cans which are normally utilized at the present time cannot withstand such vacuums, and therefore it is necessary that means be provided to pressurize the cans internally to overcome this vacuum effect.

A further usage for the liquid nitrogen or like inert gas is with respect to the ability to utilize thinner metal in the manufacture of cans, particularly can bodies. If a can body is internally pressurized, it has greater stacking strength, and thus a can body may be in part supported by the internal pressure. This permits lighter gauge metal to be utilized in the formation of the can bodies.

Although only a preferred embodiment of the controlled dispensing of a liquid inert gas has been specifically illustrated and described herein, it is to be understood that minor variations may be made in the control system and in the liquid gas dispenser without departing from the spirit and scope of the invention as defined by the appended claims.

We claim:

1. A control system for use between a container internal pressure detector and pressure indicator and a liquid inert gas dispenser and for controlling the amount of liquid inert gas dispensed upon each actuation of said dispenser, said pressure detector and pressure indicator being of the type which provides distinct signals in accordance with the existence in a container internal pressures of preselected magnitude and said inert gas dispenser including valve means for varying the quantity of inert gas dispensed in accordance with the time duration of valve opening; said control system comprising means for coupling to said pressure detector and pressure indicator for serially receiving each distinct signal resulting from a testing of a container to determine the magnitude of pressure internally of containers, averaging means for averaging data indicated by said signals, comparator means for comparing said averaged data with a preset norm, and converter means connected to said comparator means for controlling the timing of said valve means opening to vary the time of actuation of said valve means in accordance with said averaged data.

2. A control system according to claim 1 wherein said converter means is of the type for providing a valve means control pulse of a width varying in accordance with said compared averaged data.

3. A control system according to claim 1 wherein each distinct signal is in the form of exponential data and said averaging means includes a memory for converting exponential data into a digital signal.

4. A control system according to claim 3 together with converter means for converting said digital signal to an analog signal for said comparator.

5. A control system according to claim 1 wherein said comparator means includes a variable set point.

6. A control system according to claim 1 together with a container detector for association with said inert gas dispenser, and means coupling said converter means and said container detector in series with said container detector means being a no-container-no-dispensing means.

7. A control system according to claim 6 wherein said converter means is of the type for providing a valve means control pulse of a width varying in accordance with said compared averaged data, said valve means control pulse having a fixed terminal point and a variable start point, said container detector means providing a second valve means control pulse having constant start and terminal points and of a greater length than said first mentioned control pulse.

8. A control system according to claim 7 wherein said control pulses are in overlapping relation and said terminal points being common whereby termination of actuation of said valve means at a time when a container is aligned with said inert gas dispenser is assured.

9. A control system according to claim 1 wherein there is a container filling and closing line including a closing machine, said inert gas dispenser being positioned along said filling and closing line in advance of said closing machine and downstream of filling equipment for depositing liquid inert gas into an open upper part of filled containers, and said pressure detector being positioned downstream of said closing machine and spaced sufficiently from said inert gas dispenser for substantially complete vaporization of deposited inert gas.

10. A control system according to claim 1 wherein said liquid inert gas dispenser includes a tank for receiving an inert gas in liquid form, said tank having a flat bottom wall of uniform thickness, a dispensing opening formed entirely in and passing through said bottom wall, said dispensing opening including a passage defined by a valve seat formed by part of said bottom wall, a vertical plunger having at a lower end thereof a valve element normally seated on said valve seat in sealed relation, and an electromechanical actuator for said valve element, said electromechanical actuator being coupled to said converter means.

11. A control system according to claim 10 wherein said tank has filler means for introducing an inert gas in liquid form thereinto and for maintaining said liquid inert gas at a preselected level with there being a head space above the liquid level for gases, and gas distributing means connected to said head space for receiving and distributing gaseous vapors to open areas outside said tank to prevent icing.

12. A control system according to claim 11 wherein said open areas include a space below said tank bottom wall defined by a depending skirt.

13. A control system according to claim 11 wherein said open areas include a space below said tank bottom wall defined by a depending skirt, said gas distributing means distributing gas from an inside wall of said skirt.

14. A method of controlling the delivery of an inert gas under pressure into a container which is thereafter sealed and has an internal pressure, said method comprising the steps of providing a tank having therein an inert gas in liquid state with there being a discharge opening in a bottom wall of the tank controlled by valve means having an electromechanical actuator, utilizing the valve means to controllably dispense the liquid inert gas into open filled containers passing beneath the tank, closing the containers in sealed relation, testing the closed containers in sequence to determine the internal pressure of each container, taking pressure indicating results and averaging them, comparing the averaged presssure with a preselected standard, and utilizing the results of the comparison to control the length of time of opening of the valve means to thereby control the volume of the liquid inert gas dispensed into each container.

15. A method according to claim 14 wherein the results of the comparison are utilized to provide a pulse type signal having a width corresponding to the dispensing time.

16. A method according to claim 15 together with providing a container detector for determining when a container is in position for receiving a liquid inert gas charge, utilizing the results of the container detector to produce a second pulse type signal, and utilizing the combined results of said pulse type signals to both control the timing of the liquid inert gas dispensing and the volume dispensed.

17. A liquid inert gas dispenser comprising a tank for receiving an inert gas in liquid form, said tank having a flat bottom wall of uniform thickness, a dispensing opening formed entirely in and passing through said bottom wall, said dispensing opening including a passage defined by a valve seat formed by part of said bottom wall, a vertical plunger having at a lower end thereof a valve element normally seated on said valve seat in sealed relation, and an electromechanical actuator for said valve element, said tank having filler means for introducing an inert gas in liquid form thereinto and for maintaining said liquid inert gas at a preselected level with there being a head space above the liquid level for gases, and gas distributing means connected to said head space for receiving and distributing gaseous vapors to open areas outside said tank to prevent icing, said open areas including a space below said tank bottom wall defined by a depending skirt, said gas distributing means distributing gas from an inside wall of said skirt.

* * * * *